US007280082B2

(12) United States Patent
Theobold et al.

(10) Patent No.: US 7,280,082 B2
(45) Date of Patent: Oct. 9, 2007

(54) ANTENNA ARRAY WITH VANE-SUPPORTED ELEMENTS

(75) Inventors: David M. Theobold, Akron, OH (US); Stephen V. Saliga, Akron, OH (US)

(73) Assignee: Cisco Technology, Inc., San Jose, CA (US)

( * ) Notice: Subject to any disclaimer, the term of this patent is extended or adjusted under 35 U.S.C. 154(b) by 265 days.

(21) Appl. No.: 10/682,983

(22) Filed: Oct. 10, 2003

(65) Prior Publication Data

US 2005/0078046 A1 Apr. 14, 2005

(51) Int. Cl.
*H01Q 21/26* (2006.01)

(52) U.S. Cl. ..... 343/797; 343/770

(58) Field of Classification Search ..... 343/762, 343/772, 778, 844, 846, 767, 770, 771, 795, 343/797, 702, 853

See application file for complete search history.

(56) References Cited

U.S. PATENT DOCUMENTS

| | | | | |
|---|---|---|---|---|
| 5,227,808 A | | 7/1993 | Davis | 343/915 |
| 5,268,701 A | | 12/1993 | Smith | 343/767 |
| 6,072,439 A | * | 6/2000 | Ippolito et al. | 343/797 |
| 6,078,288 A | * | 6/2000 | Adams et al. | 342/372 |
| 6,140,972 A | * | 10/2000 | Johnston et al. | 343/725 |
| 6,359,596 B1 | | 3/2002 | Claiborne | 343/795 |
| 6,369,778 B1 | | 4/2002 | Dockery | 343/895 |
| 6,552,691 B2 | * | 4/2003 | Mohuchy et al. | 343/770 |
| 6,697,029 B2 | * | 2/2004 | Teillet et al. | 343/797 |
| 6,747,606 B2 | * | 6/2004 | Harel et al. | 343/808 |
| 6,933,905 B2 | * | 8/2005 | Ippolito | 343/797 |
| 2003/0227420 A1 | * | 12/2003 | Roper et al. | 343/797 |

FOREIGN PATENT DOCUMENTS

| | | |
|---|---|---|
| EP | 1 182 731 A2 | 2/2002 |
| WO | WO-02-23669 A1 | 3/2002 |

OTHER PUBLICATIONS

Int'l Search Report for International Application No. PCT/US2004/028785 filed on Sep. 3, 2004.

* cited by examiner

*Primary Examiner*—Douglas W. Owens
*Assistant Examiner*—Jimmy Vu
(74) *Attorney, Agent, or Firm*—Tucker Ellis & West LLP

(57) ABSTRACT

A multiple element antenna array is disclosed in which a plurality of panels each support one or more antenna elements. One or more of the panels are preferably interlaced, so as to be affixed to a circuit board. The panels are configured so as to affix to the circuit board at a predetermined angle, which is preferably a right angle to the surface of the circuit board. Each antenna element includes a connection point for establishing a circuit board connection. The present multiple element antenna array is preferably incorporated into a wireless device; preferably an access point for a wireless local area network (WLAN). The wireless device further includes a radio transceiver comprising a plurality of circuit elements mounted on the circuit board.

20 Claims, 4 Drawing Sheets

ANTENNA ARRAY WITH VANE-SUPPORTED ELEMENTS

BACKGROUND OF THE INVENTION

Multiple element antenna arrays are employed within multi-channel receivers and also in active and passive receiving arrays. Such antenna arrays are typically fabricated using printed, plated, stamped, or electroformed array elements, where the techniques for forming such elements are known in the art. Such arrays are typically formed on a two-dimensional substrate to form a planar array. However, such two-dimensional topologies have constraints that make a planar array unsuitable for certain antenna applications.

The constraints of a two-dimensional planar antenna array would conceivably be overcome by placing single antenna elements within a volume to create an array having a three-dimensional configuration. However, such three-dimensional topologies have heretofore typically required combinations of monopole or dipole elements, resulting in a large number of individual components. It is problematic to integrate a large number of array elements at precise locations into a 3-D volume, while maintaining a low parts count and thereby achieving a low cost.

Other alternatives have been contemplated in seeking to obtain a higher level of integration, like using periodic structures such as waveguides. But the manufacturing of such devices is specialized, and thus costly. As a result, it has been difficult and/or expensive to create integrated 3-D arrays that use passive and active array multi-channel technology, particularly for integration into a wireless LAN access point.

SUMMARY OF THE INVENTION

The difficulties and drawbacks of previous type arrangements are overcome by the presently disclosed multiple element antenna array. A plurality of panels are disclosed, each supporting one or more antenna elements. One or more of the panels are preferably interlaced, so as to be affixed to a circuit board. The panels are configured so as to affix to the circuit board at a predetermined angle, which is preferably a right angle to the surface of the circuit board. Each antenna element includes a connection point for establishing a circuit board connection. The present multiple element antenna array is preferably incorporated into a wireless device; preferably an access point for a wireless local area network (WLAN). The wireless device further includes a radio transceiver comprising a plurality of circuit elements mounted on a circuit board.

As will be realized, the invention is capable of other and different embodiments and its several details are capable of modifications in various respects, all without departing from the invention. Accordingly, the drawings and description are to be regarded as illustrative and not restrictive.

DETAILED DESCRIPTION OF THE INVENTION

Figure 1A:
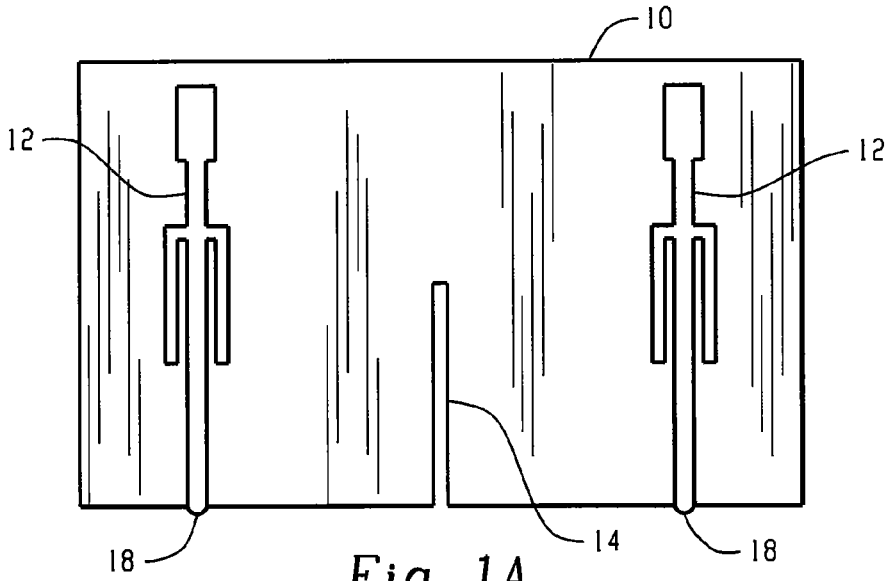
FIGS. 1A and B respectively show a panel for supporting one or more representative antenna elements and an exploded view of a four element example interlaced panel arrangement, in accordance with the presently disclosed embodiments.

As shown in the figures, the disclosed embodiments are directed to a multiple element antenna array. As particularly shown in FIG. 1A, the multiple element antenna array is formed of one or more panels 10, with each supporting one or more representative antenna elements 12. An antenna element 12 may be one of any single radiating electromagnetic elements typified by a monopole, dipole, loaded monopole, collinear monopoles, or similar such element. The panel 10 preferably includes a notch 14 for allowing a connection to another respective panel 10. As particularly shown in FIG. 1B, a number of panels 10 are preferably interlaced, so as to join the panels 10 together. The interlacing is performed by sliding the notches together, so that the surfaces are joined at an angle to each other. The panels 10 are then affixed to a circuit board 16 at a predetermined angle, as will be set forth in detail below. A connection point 18 is provided on each antenna element 12 for establishing a connection to the circuit board 16.

Figure 1B:
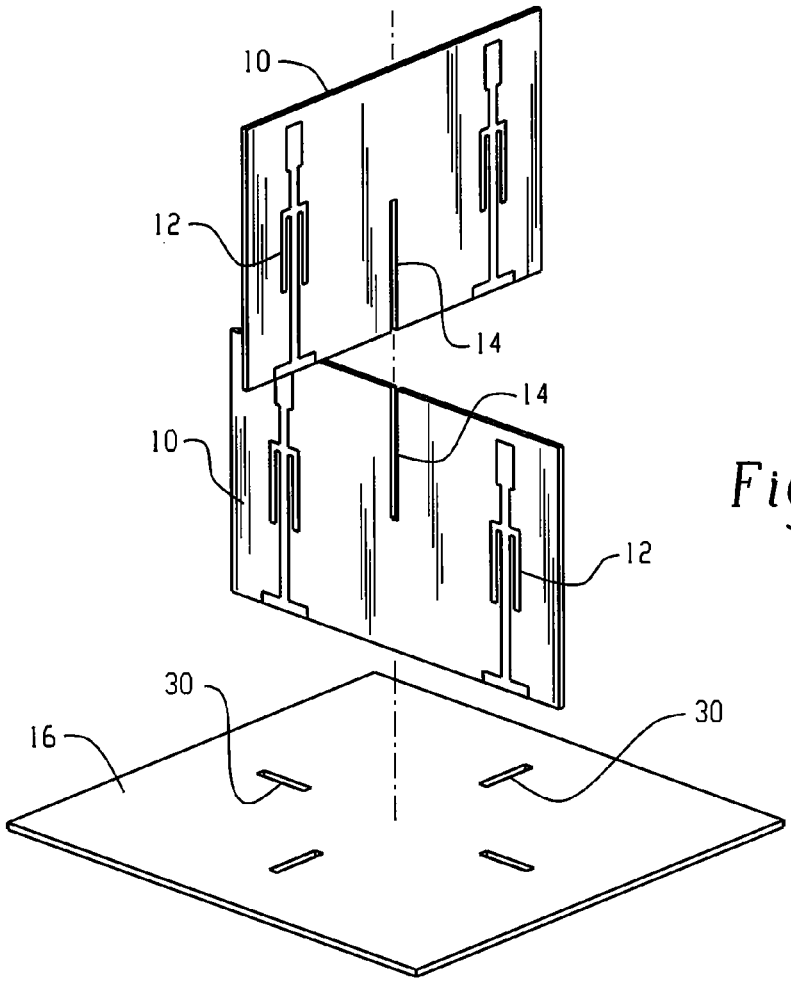
Figure 2A:
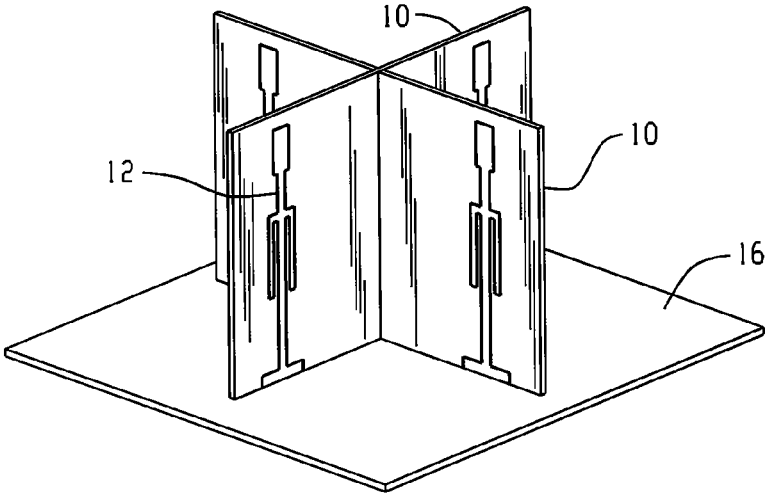
FIGS. 2A, 2B and 2C depict alternative embodiments of the present multiple antenna array.
Figure 3A:
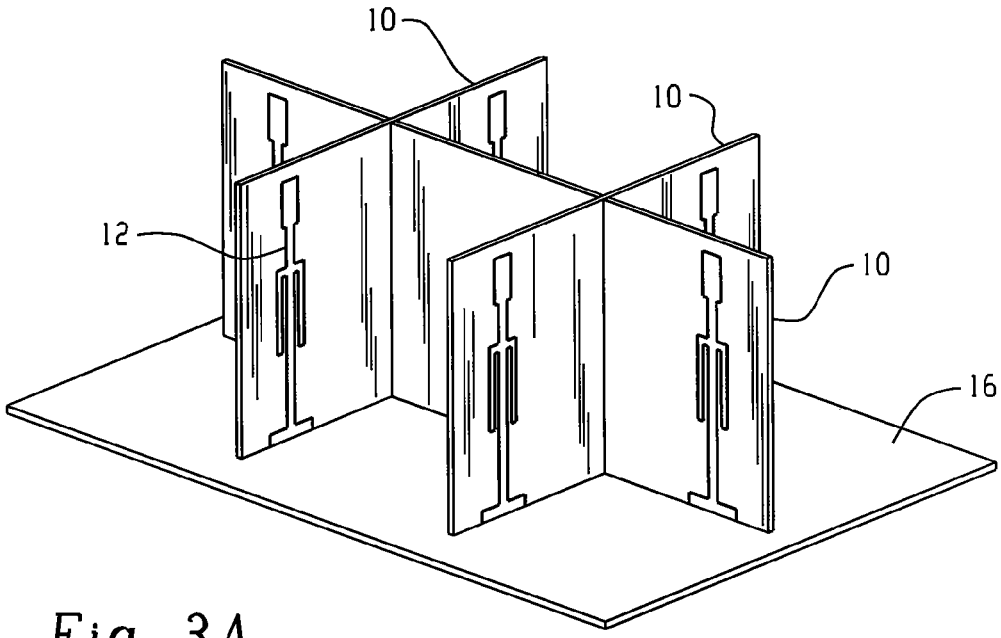
FIGS. 3A and 3B depict further alternative embodiments of the present multiple antenna array.
Figure 3B:
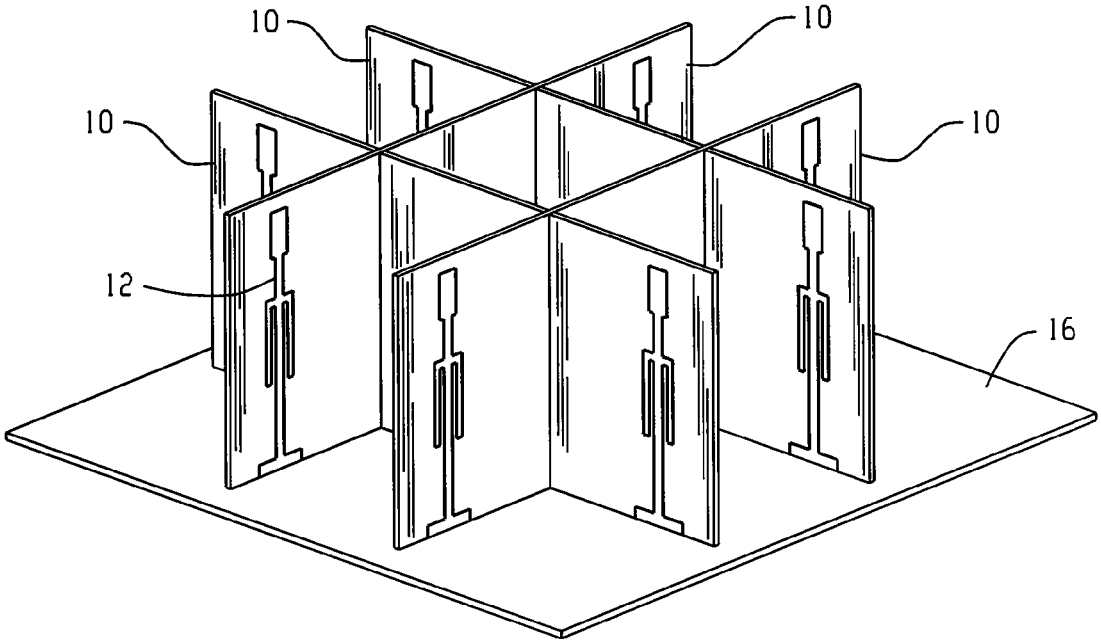

As shown in FIG. 1B and FIG. 2A, a multiple element antenna can be configured by two panels 10 interlaced at a right angle to form a cross-shaped antenna array. In such an arrangement, the predetermined angle for affixing the panels 10 would be mutually perpendicular to the circuit board 16. In other embodiments, as shown in FIGS. 3A and 3B, a panel 10 can be interlaced at right angles to more than one panel 10, where each panel 10 is interlaced at respective positions separated from each other by a predetermined distance. As shown in FIG. 3A, two panels 10 can be made to interlace with a single panel 10 of suitable length, to define the desired separation. As shown in FIG. 3B, two panels 10 of suitable length can be interlaced with two other such panels 10 to make a "tic-tac-toe" pattern.

Figure 2B:
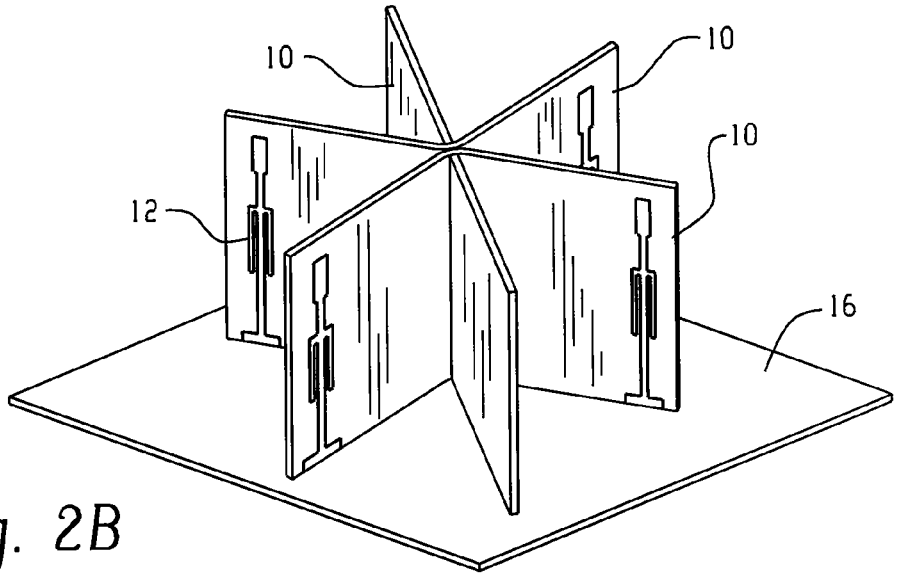
Figure 2C:
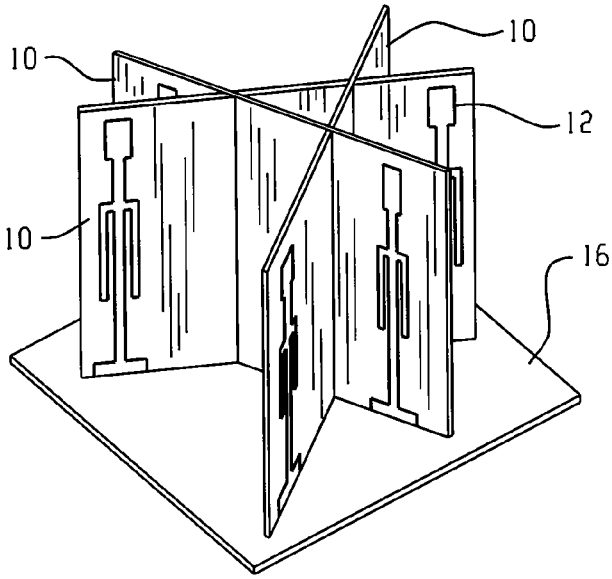

Any number of panels 10 can alternatively be interlaced along a common axis of intersection, to form a "star-shaped" antenna array. As shown in FIG. 2B, three panels 10 can be joined in this manner. Of the three panels 10 of FIG. 2B, two panels are preferably folded at an angle of 120 degrees prior to being slotted and joined by the third slotted panel. It should be appreciated that any number of panels 10 can be interlaced in any position or angular orientation. For example, as shown in FIG. 2C, the panels 10 may intersect in a non-orthogonal and/or a non-coaxial manner. Also, any number of antenna elements 12 can be placed on the panels 10 to provide any desired phase difference or antenna radiation pattern that could be determined. For example, one antenna element 12 can be placed on one side of the panel 10 or two antenna elements 12 can be placed at opposite ends of the one side. Also, one or more antenna elements 12 can be placed at opposite sides of a panel 10.

In the preferred embodiment, the panels 10 are formed of printed circuit board material with at least one antenna element formed thereon. For example, the circuit board material can be 20 mil thick circuit board material, or any other type suitably similar material, such as would be appreciated by those skilled in the art. The antenna elements 12 can be formed on the board by etching, machining, or other such circuit board manufacturing techniques as are known in the art. The antenna element 12 as depicted in the drawings is just one of any type of suitable antenna configuration, and the drawing is provided by way of example and should not be construed as in any way limiting.

Figure 4A:
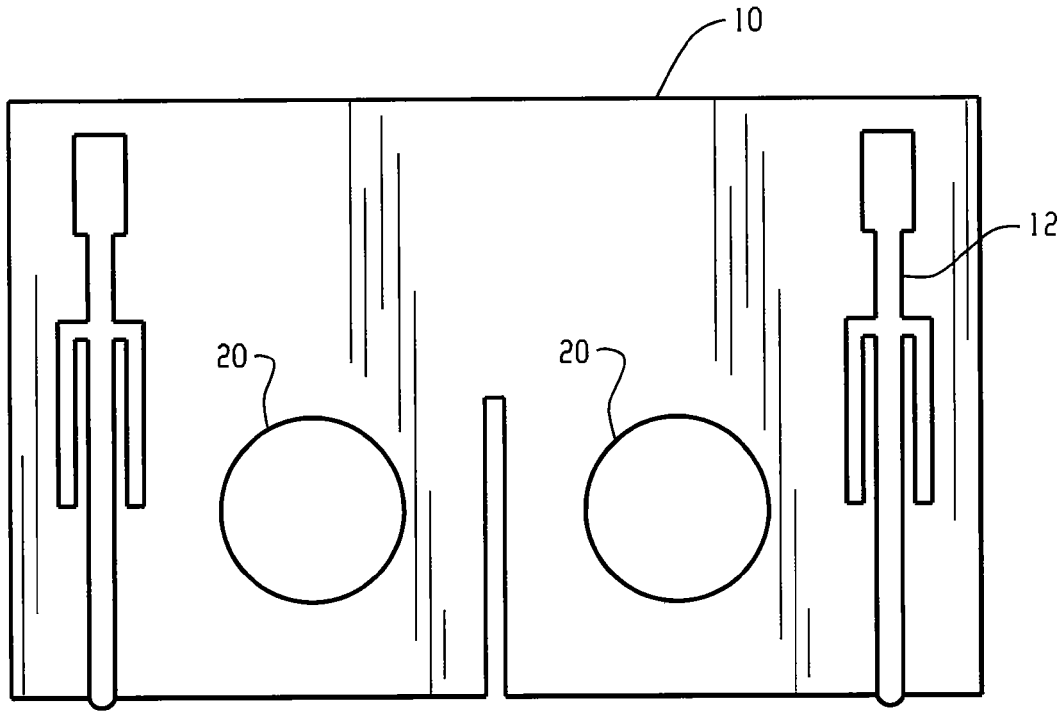
FIGS. 4A and 4B respectively show a panel element further including a non-radiating electronic component, and a general depiction of a wireless device with electronic components separated from the receiver.
Figure 4B:
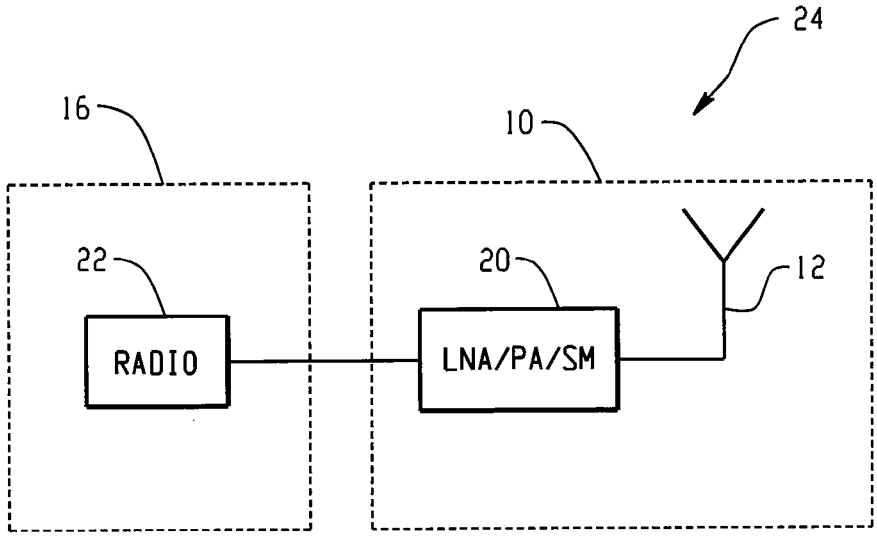

Since the panels 10 are formed of circuit board material, it should be appreciated that the panels 10 can also be used to support electronic components of the wireless radio device. As shown particularly in FIG. 4A, one or more non-radiating electronic components 20 can be affixed to a panel 10, e.g. a low-noise amplifier (LNA), power amplifier (PA), switch (SW) used in conjunction with the antenna 12. As shown schematically in FIG. 4B, the LNA/PA/SW 20 can be mounted onto the panel 10 with the antenna 12 and the radio receiver components 22 can be mounted to the circuit board 16. In this way, the present arrangement has particular applicability as a wireless access point 24. It should be appreciated that other radio elements from the receiver 22 can also be distributed unto the panels 10. In fact, in an embodiment where a sufficient number of panels 10 of sufficient size are employed, the entire radio circuitry from the receiver can be distributed across the panels 10, such that the panels 10 become the circuit board 16 for the device, thereby eliminating a discrete circuit board component. Feed lines for the various components may be integrated (printed) onto the surfaces of the panels 10. Phase delay elements may also be integrated onto the surfaces of the planes.

As shown especially in FIG. 1A, the connection points 18 of the antenna members 12 can be a tap for being received into and soldered onto the circuit board 16. Alternatively, as shown in FIG. 1B, the connection points 18 can be connector portions for being received into respective slots 30 on the circuit board 16. In this way, the multiple antenna arrays can be modular components removable from the slots 30 in a manner similar to standard cards that are used in other electronic components, thereby allowing upgrades and replacement. In any event, since the panels 10 are fully integrated single pieces, the present embodiments thereby reduces parts count for a multiple element array.

The presently disclosed embodiments offer flexibility, low cost, precise element registration, and ease of assembly. This design is easy to manufacture with low cost materials. As to the performance of the present system, the far-field pattern functions that have been measured have demonstrated well-defined electromagnetic characteristics that lend themselves to use in active or passive array antennas. In this way, the present configuration will fit well into future architectures for multi-channel passive and active array antennas as used with wireless LAN access points.

A two-panel arrangement as shown in FIG. 2A was configured as a four-element array in which four elements are fabricated so that each element 12 faces the backside of each respective other antenna element 12 as one traverses the planes. This model was simulated to ascertain its array pattern performance. A 3-D pattern of the individual array elements 12 has excellent azimuth symmetry. These elements are placed on the boards as discussed above and combined with zero degree phase difference in one plane and +/−90 degree phase difference in the orthogonal plane. The resultant phase combined pattern forms a 7.9 dBi beam along the Z-axis of each antenna. The resulting symmetry is excellent, with the first sidelobes being down about 8 dB. This form of array is suitable for a variety of passive, switched, or active array antenna applications.

As described hereinabove, the present invention solves many problems associated with previous type systems. However, it will be appreciated that various changes in the details, materials and arrangements of parts which have been herein described and illustrated in order to explain the nature of the invention may be made by those skilled in the area within the principle and scope of the invention as will be expressed in the appended claims.

We claim:

1. A wireless device comprising:

a radio transceiver comprising a plurality of circuit elements mounted on a circuit board; and a multiple element antenna array comprising:

a plurality of panels, each supporting at least one antenna element, for affixing to the circuit board at a predetermined angle, wherein at least two of the plurality of panels are interlaced with each other;

a connection point on each antenna element for establishing a connection to the circuit board; and a non-radiating electronic components affixed to at least one panel;

wherein at least three panels are interlaced along a common axis of intersection, to form a star-shaped antenna array;

wherein the panels are formed of printed circuit board material with at least one antenna element formed thereon.

2. The wireless device of claim 1, wherein the non-radiating electronic components comprise at least one low-noise amplifier/power amplifier/switch for cooperating with a respective antenna element.

3. The wireless device of claim 2, wherein the wireless device is a wireless access point for a wireless local area network (WLAN).

4. The wireless device of claim 1, wherein the connection points comprise a connector for being received in a receptacle on the circuit board.

5. The wireless device of claim 1, wherein the connection points comprise a tap for being received into the circuit board.

6. The wireless device of claim 1, wherein the connection points are soldered onto the circuit board.

7. A wireless device comprising:

a radio transceiver comprising a plurality of circuit elements mounted on a circuit board;

and a multiple element antenna array comprising:

a plurality of panels, each supporting at least one antenna element, for affixing to the circuit board at a predetermined angle, wherein at least two of the plurality of panels are interlaced with each other, and a connection point on each antenna element for establishing a connection to the circuit board;

wherein the wireless device is a wireless access point for a wireless local area network (WLAN);

wherein the panels are formed of printed circuit board material with at least one antenna element formed thereon.

8. The wireless device of claim 7, further comprising non-radiating electronic components affixed to at least one panel.

9. The wireless device of claim 8, wherein the non-radiating electronic components comprise at least one low-noise amplifier/power amplifier/switch for cooperating with a respective antenna element.

10. The wireless device of claim 7, wherein at least two of the plurality of panels are interlaced at a right angle to form a cross-shaped antenna array, for affixing mutually perpendicular to the circuit board.

11. The wireless device of claim 7, wherein at least one panel is interlaced at right angles with at least a portion of the remaining panels, at respective positions having predetermined separations.

12. The wireless device of claim 7, wherein at least three panels are interlaced along a common axis of intersection, to form a star-shaped antenna array.

13. The wireless device of claim 7, wherein the connection points comprise a connector for being received in a receptacle on the circuit board.

14. The wireless device of claim 7, wherein the connection points comprise a tap for being received into the circuit board.

15. The wireless device of claim 7, wherein the connection points are soldered onto the circuit board.

16. A multiple element antenna array comprising:

a plurality of panels, each supporting at least one antenna element, for affixing to a circuit board at a predetermined angle; and a connection point on each antenna element for establishing a circuit board connection;

wherein at least a two of the plurality of panels are interlaced with each other to form an antenna array affixed to the circuit board;

wherein at least three panels are interlaced along a common axis of intersection, to form a star-shaped antenna array; and wherein the panels are formed of printed circuit board material.

17. The multiple element antenna array of claim 16, further comprising non-radiating electronic components affixed to at least one panel.

18. The multiple element antenna array of claim 16, wherein the connection points comprise a connector for being received in a receptacle on the circuit board.

19. The multiple element antenna array of claim 16, wherein the connection points comprise a tap for being received into the circuit board.

20. The multiple element antenna array of claim 19, wherein the connection points are soldered onto the circuit board.

* * * * *